US005927734A

United States Patent [19]

Horton, II et al.

[11] Patent Number: 5,927,734

[45] Date of Patent: Jul. 27, 1999

[54] SCOOTER

[75] Inventors: Edward N. Horton, II, Rossville, Ga.; Michael E. Smith, Chattanooga, Tenn.

[73] Assignee: Rod Enterprises, LLC, Chattanooga, Tenn.

[21] Appl. No.: 08/383,068

[22] Filed: Feb. 3, 1995

[51] Int. Cl.[6] ..... A63C 17/04

[52] U.S. Cl. ..... 280/87.042; 280/11.2

[58] Field of Search ..... 280/87.01, 87.041, 280/87.042, 87.021, 87.043, 87.05, 11.27, 11.2

[56] References Cited

U.S. PATENT DOCUMENTS

| | | | |
|---|---|---|---|
| D. 120,019 | 4/1940 | Rodriguez . | |
| D. 176,725 | 1/1956 | Laibow et al. | 280/87.041 X |
| D. 187,706 | 4/1960 | Jenkins . | |
| D. 199,682 | 12/1964 | Jezowski . | |
| 3,565,454 | 2/1971 | Stevenson . | |
| 3,795,409 | 3/1974 | Cudmore . | |
| 4,029,330 | 6/1977 | Runyan, Jr. . | |
| 4,060,253 | 11/1977 | Oldendorf . | |
| 4,082,306 | 4/1978 | Sheldon . | |
| 4,089,536 | 5/1978 | Larrucea . | |
| 4,095,817 | 6/1978 | Cohen | 280/87.042 |
| 4,133,548 | 1/1979 | Smith . | |
| 4,337,963 | 7/1982 | Stevenson . | |
| 4,460,187 | 7/1984 | Shimizu | 280/87.042 X |
| 4,505,477 | 3/1985 | Wilkinson . | |
| 4,807,896 | 2/1989 | Phillippi | 280/87.042 X |
| 5,417,444 | 5/1995 | Chen | 280/87.042 |

FOREIGN PATENT DOCUMENTS

| | | |
|---|---|---|
| 2416-027 | 10/1979 | France . |
| 2733093 A1 | 2/1979 | Germany . |
| 3442-193 | 11/1985 | Germany . |
| 2163659 A1 | 3/1986 | United Kingdom . |

OTHER PUBLICATIONS

*Skateboarder* Magazine, vol. 4, No. 8 (Mar., 1978), pp. 138–139.

Smith–Horton Enterprises, Inc. brochure, 1993.

*Primary Examiner*—J J Swann
*Assistant Examiner*—Michael Mar
*Attorney, Agent, or Firm*—Baker, Donelson, Bearman & Caldwell

[57] ABSTRACT

A concave, multi-planed scooter for performing riding tricks having handles attached to at least one end of the scooter's generally concave riding platform for a person, who is supported by the platform and riding the scooter, to hold onto. The handles are angled such that a rider's feet are placed properly for a well-centered riding position. The improved scooter has a wheel assembly attached to the underside of the platform beam in a directional alignment that provides the various planar surfaces of the riding platform with relatively wider or relatively tighter turning radii. Moreover, the wheel assembly may be mounted by a pinion nut system that allows the scooter ease in steering and includes an adjustment lock-nut for tight or loose steering. The two center wheel assemblies may be mounted on wedge-shaped spacers that position the wheel assemblies away from the underside of the platform beam for better stability and shock absorption. The scooter also has a decelerator consisting of a decelerator seat and decelerator pad attached to the underside of the platform beam, which pad is easily replaced when worn by removal of a screw or other means for fastening the decelerator to the underside of the platform beam.

7 Claims, 7 Drawing Sheets

FIG 5c
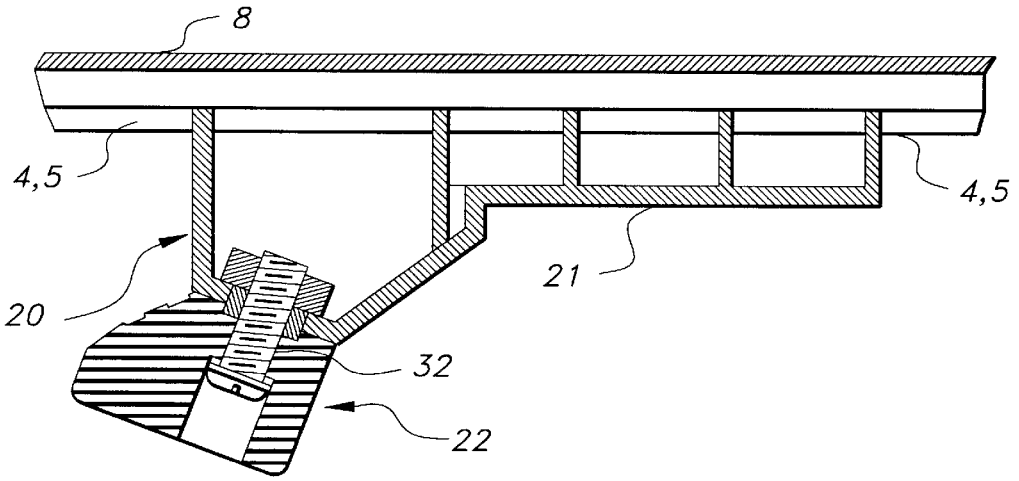
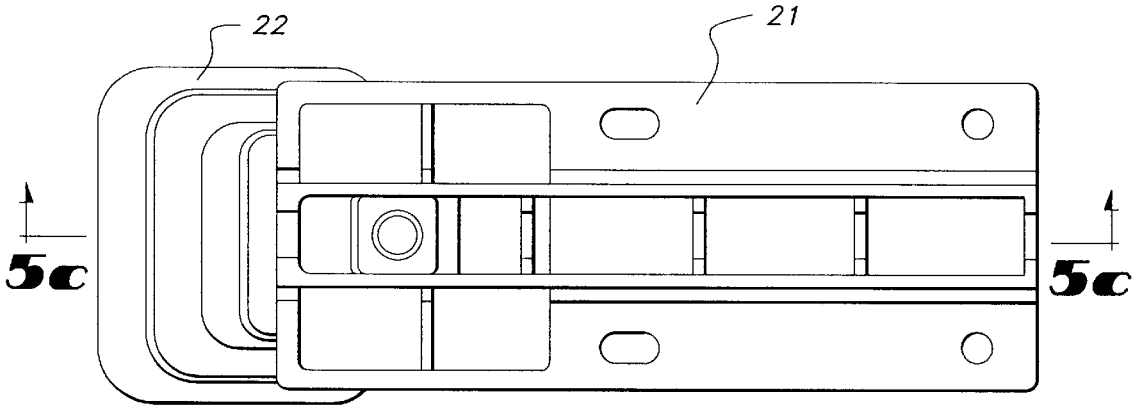
FIG 5d

SCOOTER

TECHNICAL FIELD

This invention relates generally to scooters, and more particularly concerns an improved multi-planed scooter for performing riding tricks, the characteristics of which result in a choice of turning radii, ease in steering and adjustability of steering, and improved riding stability, shock absorption, and deceleration.

BACKGROUND OF THE INVENTION

Although scooters are common and configured in many different designs, most known scooters consist of a horizontal riding platform with a plurality of wheels thereunder, and a holding means projecting perpendicularly therefrom. Such scooters are exemplified by, for example, U.S. Design Patent No. 120,019 to Rodriguez and U.S. Design Patent No. 187,706 to Jenkins. Similarly, skateboards are well known in the art, and generally consist of a single riding surface with a plurality of wheels, but lacking any holding means. Such skateboards and exemplified by, for example, U.S. Pat. No. 4,337,963 to Stevenson, U.S. Pat. No. 4,089,536 to Larrucea, and U.S. Pat. No. 3,565,454 to Stevenson.

Apart from applicant's own experimental wooden prototype, only one example of a multi-planed scooter is exemplified by the prior art. U.S. Pat. No. 4,133,548 to Smith describes a scooter for performing riding tricks, consisting of a generally concave riding platform with interior and exterior surfaces, preferably comprising three elongated platform beams connected together at angles, with a holding means attached to at least one end of the platform, and a plurality of roller means attached to the exterior platform surfaces near the junctures of the platform beams. The Smith scooter shifts from one riding position to another when the person riding the scooter shifts the weight of his body while rolling on a riding surface. The Smith scooter, however, was found to be abrupt and inconvenient to maneuver. The present invention is directed to overcoming these problems.

SUMMARY OF THE INVENTION

Therefore, it is an object of the present invention to provide an improved concave, multi-planed scooter for performing riding tricks which has inwardly curved handles with an outward bend to hold onto for a safer, well-centered riding position.

It is likewise an object of the present invention to provide an improved concave, multi-planed scooter that has wheel assemblies attached to the underside of the riding platform and positioned thereby to provide a choice of turning radii, better stability, ease in steering, adjustability of steering, and ease in shifting from one riding surface to another.

It is also an object of the present invention to provide an improved, multi-planed scooter which has a decelerator attached to the underside of the riding platform to enhance the safety of the scooter by improving the rider's control over the speed of the scooter.

It is another object of the present invention to provide an improved concave, multi-planed scooter which has removable board surfaces capable of carrying graphic designs and manufactured from reinforced injection molded plastic to enhance the attractiveness of the scooter.

The foregoing objectives are achieved by an improved concave, multi-planed scooter consisting of a special shaped concave riding platform formed by a multi-bent, multi-angular, double-tubular steel platform beam; a plurality of wheel assemblies; and a plurality of plastic, non-slip riding surfaces. The improved scooter has inwardly curved handles with an outward bend which extend from at least one end of the double-tubular steel platform beam. The improved scooter also has a plurality of wheel assemblies that are mounted to the underside of the platform beam by means of a pinion nut system that allows the scooter ease in steering and includes an adjustment lock-nut to provide the option of tight or loose steering. The wheel assemblies adjacent the center riding surface are mounted on wedge-shaped spacers that position the wheel assemblies away from the double-tubular steel platform beam for better stability and shock absorption. The wheel assemblies are also positioned away from the center planar riding surface for ease in shifting from one riding surface to another. A decelerator consisting of a decelerator seat and a decelerator pad is mounted to the underside of the platform beam toward the end of one of the terminal planar riding surfaces. The decelerator provides deceleration for the rider when the attached riding surface is tilted to engage the decelerator pad with the ground or cement surface on which the improved scooter is being ridden.

Other objects and advantages of the invention will become apparent upon reading the following detailed description and upon reference to the drawings.

BRIEF DESCRIPTION OF THE DRAWINGS

FIG. 5*c* is a longitudinal section through the decelerator of the embodiment of the improved multi-planed scooter of this invention.

FIG. 5*d* is a top view of the decelerator.

DETAILED DESCRIPTION OF THE INVENTION

While the invention will be described in connection with the preferred embodiment, it will be understood that we do not intend to limit the invention to that embodiment. On the contrary, we intend to cover all alternatives, modifications, and equivalences may be included within the spirit and scope of the invention as defined by the appended claims.

Figure 1:
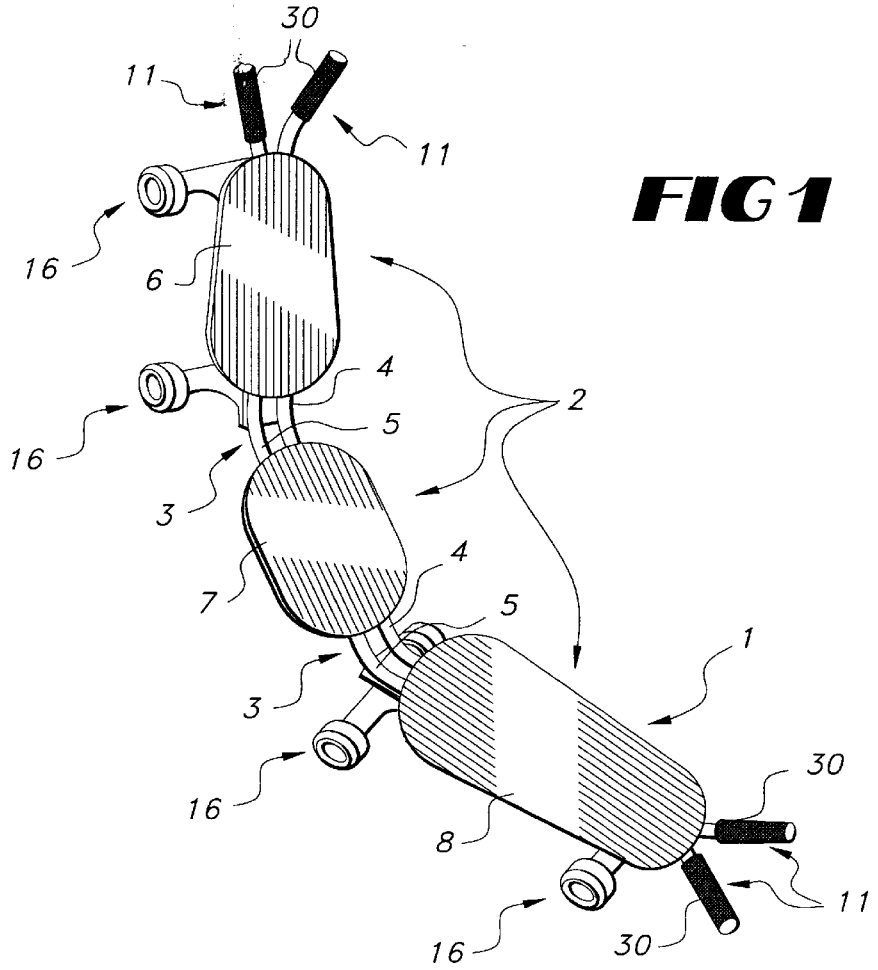
FIG. 1 is a perspective view of the embodiment of the improved multi-planed scooter in an upright or scooter-like riding position. The improved scooter is also depicted in FIGS. 1 through 4, 4*a,* and 4*b.*

Turning to FIG. 1, there is shown an improved concave, multi-planed scooter 1 embodying the present invention. The improved scooter 1 may be ridden in at least five different ways: As a scooter, as shown in FIG. 1, by placing one foot on riding surface 8 of the multi-planed riding platform 2; as a "sidewalk bobsled," in the position shown in FIG. 2, by sitting on riding surface 7 with the rider's feet on one of the two other riding surfaces 6 or 8, and the rider's back on the remaining riding surface 6 or 8; as a surfboard, also using the position shown in FIG. 2, by standing on riding surface 7 and holding handle portions 11 at either end of scooter 1; by straddling the scooter 1, with the rider's feet on riding surfaces 6 and 8; and in transition from riding one planar riding surface 6, 7 or 8 to another, by pivoting in a circle on either of the central wheel and truck assemblies 16. The improved scooter 1 is also shown in FIG. 3.

Figure 2:
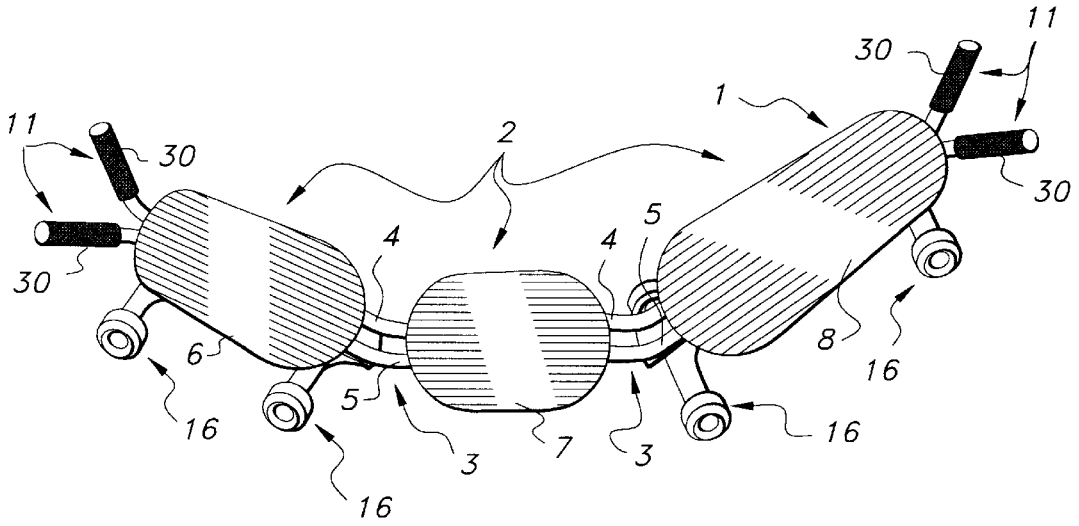
FIG. 2 is a perspective view of the improved multi-planed scooter in a standing, sitting, squatting, lying-down, or trick-riding position.
Figure 3:
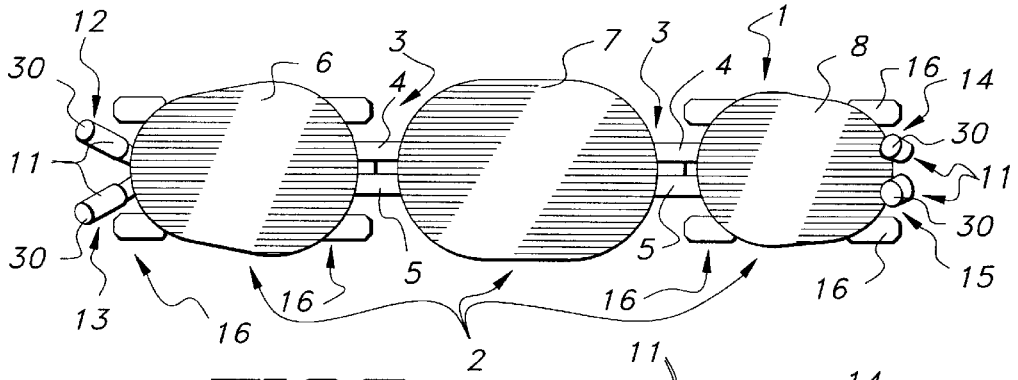
FIG. 3 is a top view of the embodiment of the improved multi-planed scooter of this invention.

As may be appreciated from FIGS. 1, 2 and 3, the riding platform 2 consists of riding surfaces 6, 7 and 8. The riding surfaces 6, 7, and 8 are formed of plastic, preferably injection molded nylon polypropylene plastic, of differing lengths such that the scooter 1 possesses the ability to make turns of differing radii, depending upon which riding surface 6, 7 or 8 is being utilized. The riding surfaces 6, 7, and 8 are removable by ordinary means preferably machine screws, and are capable of being imprinted with both a textured non-slip surface and attractive graphics, and on the underside are molded with reinforcing ribs in a waffle configuration with molded grooves to align space, and secure the double steel tubular members 4 and 5 of the platform beam 3.

Figure 4A:
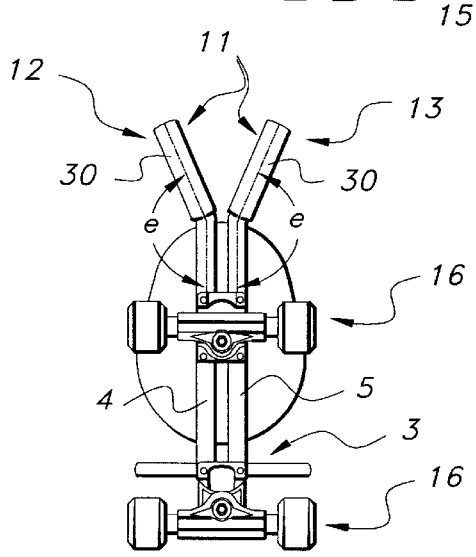
FIG. 4*a* is a first end view of the improved multi-planed scooter of this invention.
Figure 4B:
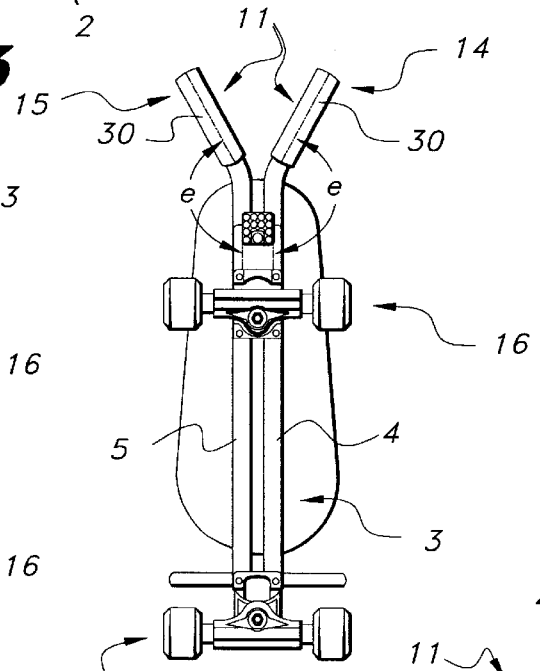
FIG. 4*b* is a second end view of the embodiment of the improved multi-planed scooter of this invention.
Figure 4:
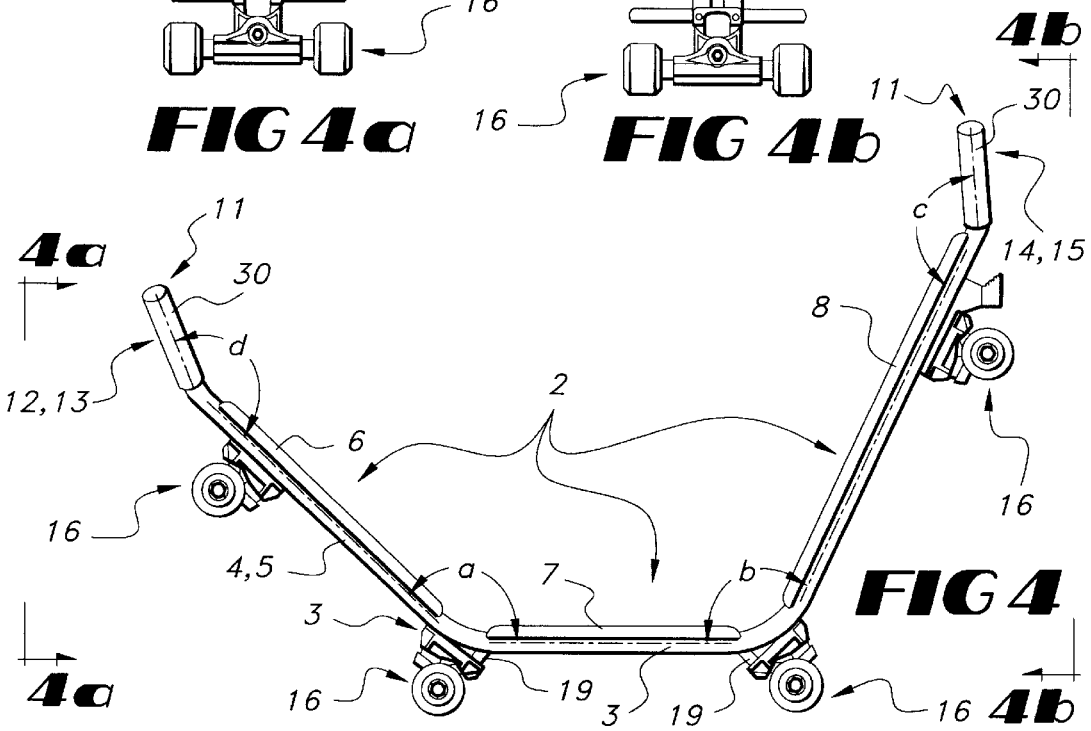
FIG. 4 is a side view of the embodiment of the multi-planed scooter.

Turning to FIG. 4, the double steel tubular members 4 and 5 of platform beam 3 are bent to form the configuration shown at an angle a of between 139.5 degrees and 133.5 degrees, preferably 136.5 degrees, between riding surfaces 6 and 7, and at an angle b of between 119.5 degrees and 112.5 degrees, preferably 116 degrees, between riding surfaces 7 and 8. The double steel tubular members 4 and 5 of platform beam 3 are also bent in two additional directions at each end of the tubular members 4 and 5 to form the handle portions 11.

Still referring to FIG. 4, tubular members 4 and 5 are also bent to form the configuration shown at an angle c of between 135 degrees and 175 degrees, preferably 150 degrees, from the plane of the adjacent riding surface 8 and toward the rider to form the first handles 14 and 15. Tubular members 4 and 5 are still further bent at an angle d of between 137 degrees and 177 degrees, preferably 152 degrees, from the plane of the adjacent riding surface 6 and toward the rider to form the second handles 12 and 13.

Referring to FIGS. 4*a* and 4*b*, the handle portions 11 of tubular members 4 and 5 are bent at an angle e of between 90 degrees and 180 degrees, preferably 155 degrees, away from the center line of each tubular member 4 or 5 as positioned in parallel under the adjacent riding surface 6 or 8. The handle portions 11 so formed are thus appropriately angled for tipping the skateboard up in the air by applying pressure from a person's foot to the handle portions 11. In addition, the handle portions 11 thus configured operate to place the rider's feet further back on riding surfaces 6 or 8 for a better centered riding position.

Referring to FIGS. 4, 4*a*, and 4*b*, it may be appreciated that the degree of angled bend of the handle portions 11 both outward and inward, as depicted, is critical to the performance of the improved scooter 1 for balance and safety. In addition, the degree of angled bend of the riding platform 2 beneath the riding surfaces 6, 7, and 8 is also critical to the performance of the improved scooter 1 as the rider shifts his body weight from one plane of the riding platform 2 to another plane thereof, the ease of which is essential when performing the multitude of riding and trick-riding positions that may be performed upon this improved skateboard 1. In fact, the dramatic change in the degree of arc of the improved scooter 1 over the prior art demonstrates the extent to which the improved scooter is better configured to enhance performance: The arc of the Smith scooter (U.S. Pat. No. 4,133,548) was preferably approximately 100 degrees (40 degrees and 60 degrees between adjacent riding surfaces). The arc of applicant's own experimental wooden prototype was preferably 107.5 degrees (43.5 degrees and 64 degrees between adjacent riding surfaces). But by bending the improved handles 11 of the present invention, an arc of approximately 165.5 degrees is obtained (43.5 degrees and 64 degrees between adjacent riding surfaces 6, 7, and 8, plus 30 degrees for first handles 14, 15 and 28 degrees for second handles 12, 13). This significantly greater degree of arc facilitates improved performance by providing greater riding security, a better centered riding position and greater control in steering.

Figure 7:
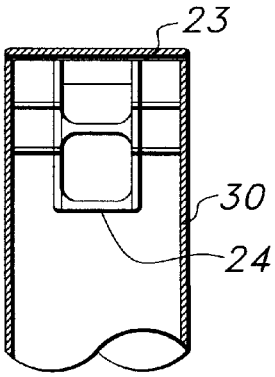
FIG. 7 is a side sectional view of the plastic cap and button of the handles of the present invention.
Figure 8:
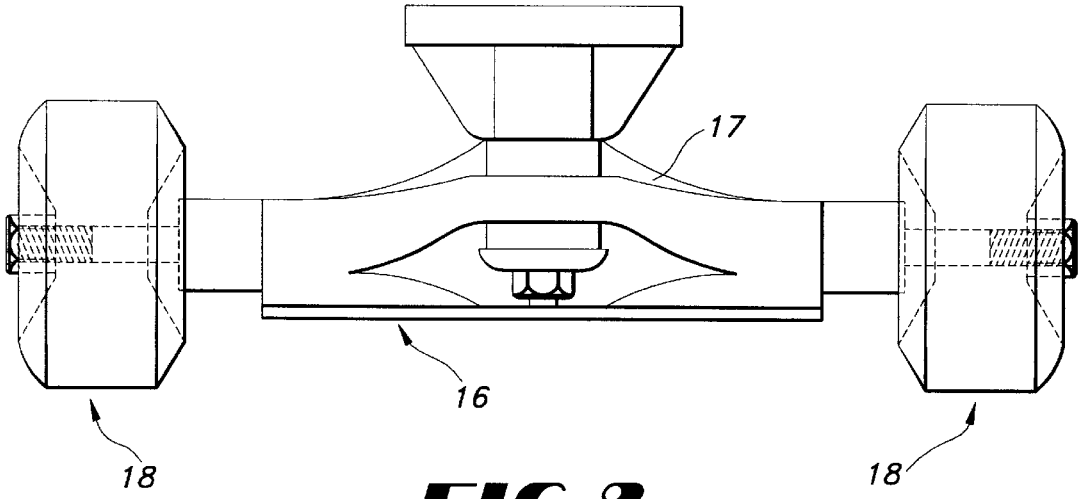
FIG. 8 is a front view of a wheel assembly of the improved multi-planed scooter of this invention.
Figure 8A:
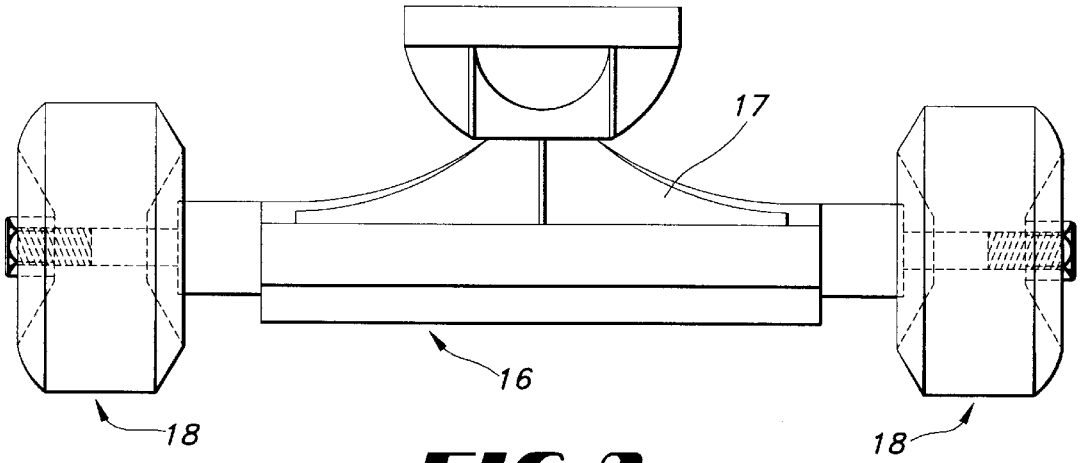
FIG. 8*a* is a rear view of a wheel assembly of the present invention.
Figure 8B:
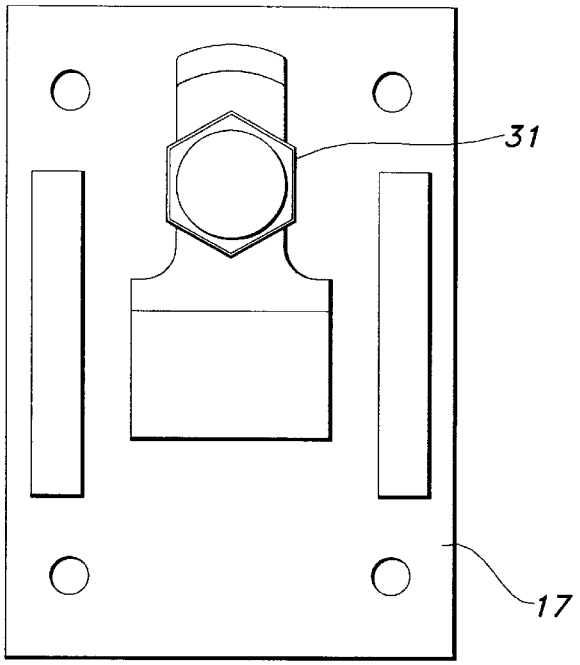
FIG. 8*b* is a top view of the truck face of the wheel assembly of the present invention.
Figure 8C:
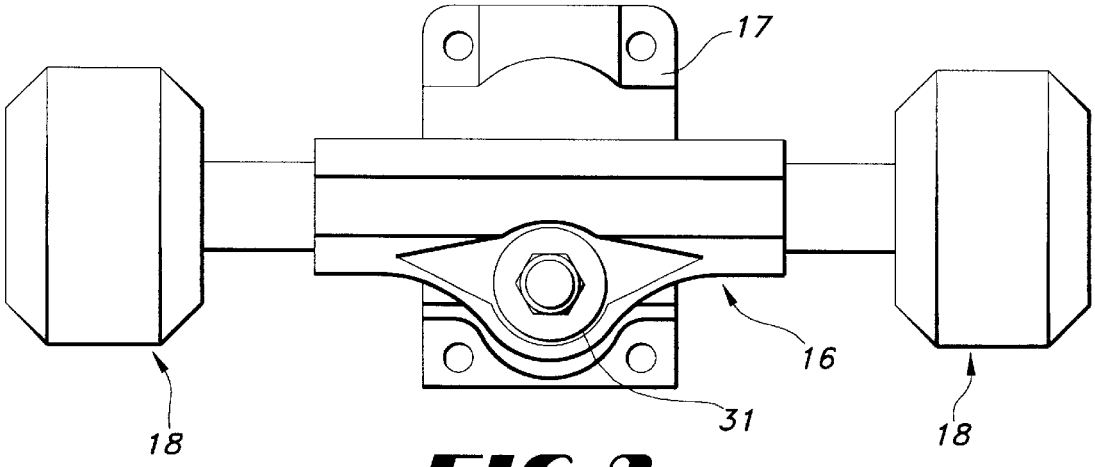
FIG. 8*c* is a bottom view of the truck face of the wheel assembly of this invention.

Referring to FIG. 7, there is depicted in isolation a plastic button 24 and cap 23 that are inserted into and over, respectively, the ends of handle portions 11. When tubular members 4 and 5 are fitted with plastic buttons 24 and fitted with plastic caps 23 prior to installation of rubber handgrips 30, the tubular members 4 and 5 are prevented from cutting through the rubber handgrips 30 as the result of long usage.

Figure 5:
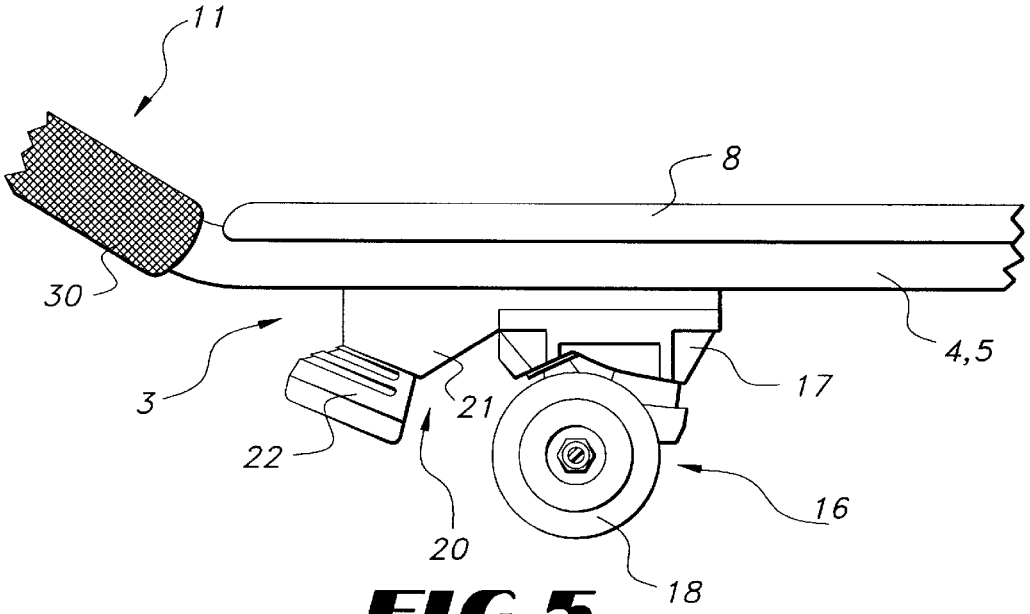
FIG. 5 is a side view of the decelerator and a wheel assembly of the embodiment of the improved multi-planed scooter depicted in FIGS. 1 through 4*b.*
Figure 5A:
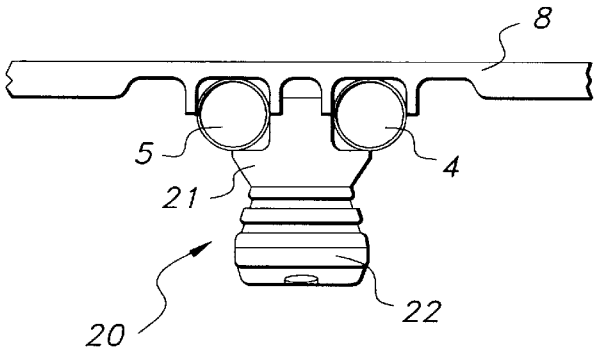
FIG. 5*a* is an end view of the decelerator of the embodiment of the improved multi-planed scooter of this invention.
Figure 5B:
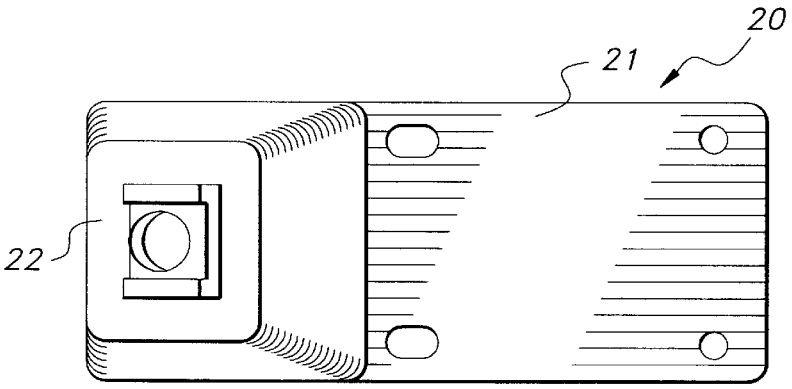
FIG. 5*b* is a bottom view of the decelerator.

Turning now to FIG. 5, there is shown generally the wheel and truck assembly 16 and decelerator 20 of the present invention. As shown in FIGS. 5*a*, 5*b*, 5*c*, and 5*d* the decelerator 20 consists of a seat 21 and a pad 22. The decelerator seat 21 is formed of plastic, preferably molded polypropylene thermal-plastic resin. The seat 21 is mounted to the underside of platform beam 3, although it will be appreciated that the decelerator 20 could be positioned underneath riding surface 6 as well. The seat 21 fits between a truck 17 and the double steel tubular members 4 and 5 of the platform beam 2. The decelerator pad 22 is formed of a frictionally engaging material, preferably molded rubber, and attached to the decelerator seat 21 by a machine screw or other fastener 32.

FIGS. 8, 8*a*, 8*b* and 8*c* show the improved wheel assembly 16 of the present invention in greater detail. The trucks 17 are formed from plastic, preferably high-impact, injection-molded steel reinforced nylon polypropylene with a pinion nut system mounting and an adjustable lock-nut 31. Wheels 18 are plastic, preferably polyurethane, and preferably have two semi-precision bearings (not shown).

The placement of the trucks 17 is critical to the performance of the improved scooter 1. In particular, the direction in which the adjustable lock-nuts 31 are placed relative to a particular riding surface 6, 7, or 8 determines the tightness or looseness of the turning radius of the particular plane of riding platform 2 which is being ridden. In the improved scooter 1, the trucks in use when riding surface 8 is used preferably are placed so that the respective adjustable lock-nuts 31 face the center of riding surface 8, creating a relatively tight turning radius. On the other hand, the trucks in use when riding surface 7 is used, preferably are placed so that the respective adjustable lock-nuts 31 face the same direction toward riding surface 8, creating a relatively wider turning radii.

Figure 6:
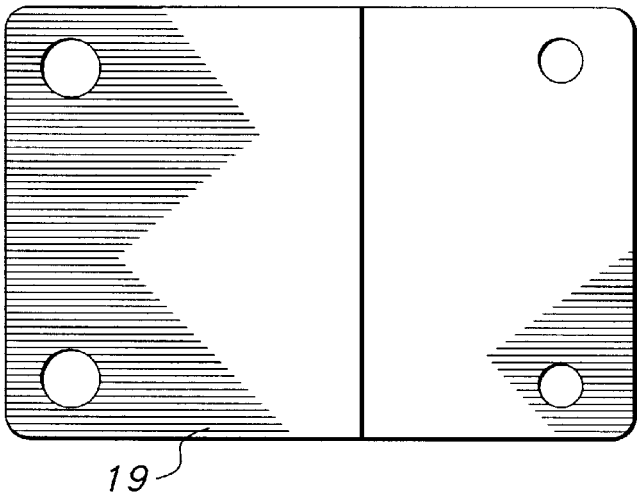
FIGS. 6, and 6*a* are top and side views, respectively, of the plastic wedge-shaped spacers for the center wheel assemblies of the present invention.
Figure 6A:
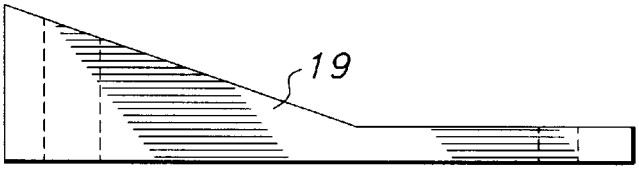

Plastic wedge-shaped spacers 19, as depicted in FIGS. 4, 6, and 6*a,* are preferably molded of polypropylene thermal-plastic resin; and positioned between the two center wheel assemblies 16 and the platform beam 3 to provide better stability and shock absorption, as well as to level the riding surfaces 6, 7, and 8 for improved riding performance.

Other aspects, objects and advantages of this invention can be obtained from a study of the drawings, the disclosure, and the appended claims.

We claim:

1. A multi-planed scooter comprising:

(a) a platform beam having a first end and a second end comprising a first tubular member having a first end and a second end and a second tubular member having first end and a second end and positioned parallel to said first tubular member thereby defining a center line between said first and second tubular members;

(b) a first platform member having a substantially planar riding surface defining a first plane and secured to said first and second tubular members of said platform beam at a position intermediate said first and second ends of said platform beam;

(c) a second platform member having a substantially planar riding surface of relatively greater length than said first riding surface and defining a second plane, secured to said first and second tubular members of said platform beam at a position intermediate said first riding surface and said second end of said platform beam, wherein said second plane arcs away from said first plane at an angle of 43.5 degrees;

(d) a third platform member having a substantially planar riding surface of relatively greater length than said second riding surface and defining a third plane, secured to said first and second tubular members of said platform beam at a position intermediate said first riding surface and said first end of said platform beam wherein said third plane arcs away from said first plane at an angle of 64 degrees;

(e) a first wheel and truck assembly having a pinion nut mounting system and an adjustable lock-nut, secured to said first and second tubular members of said platform beam opposite a portion of said third riding surface adjacent to said first end of said platform beam, such that said adjustable lock-nut faces said second end of said platform beam;

(f) a second wheel and truck assembly having a pinion nut mounting system and an adjustable lock-nut, secured to a spacer which is in turn secured to said first and second tubular members of said platform beam opposite and intermediate said first riding surface and said third riding surface, such that said adjustable lock-nut faces said first end of said platform beam;

(g) a third wheel and truck assembly having a pinion nut mounting system and an adjustable lock-nut, secured to a spacer which is in turn secured to said first and second tubular members of said platform beam opposite and intermediate said first riding surface and said second riding surface, such that said adjustable lock-nut faces said first end of said platform beam;

(h) a fourth wheel and truck assembly having a pinion and nut mounting system and an adjustable lock-nut, secured to said first and second tubular members of said platform beam opposite a portion of said second riding surface adjacent to said second end of said platform beam such that said adjustable lock-nut faces said first end of said platform beam;

(i) a decelerator comprising a seat mounted to said platform beam opposite a portion of said third riding surface intermediate said first wheel and truck assembly and said first end of said platform beam, and a frictionally engaging pad mounted to said seat;

(j) a first handle comprised of said first ends of said first and second tubular members, wherein a button is placed into each first end, a cap is placed over each first end, and a handgrip is placed over each capped first end, and said first ends arc 30 degrees away from said third plane and 25 degrees from said center line; and (k) a second handle comprised of said second ends of said first and second tubular members, wherein a button is placed into each second end, a cap is placed over each second end, and a handgrip is placed over each capped second end, and said second ends arc 28 degrees away from said second plane and 25 degrees away from said center line.

2. The invention of claim 1, wherein said spacers are wedge-shaped molded plastic spacers mounted between said wheel and truck assemblies and said platform beam.

3. The invention of claim 2, wherein said plastic spacers are formed of molded polypropylene thermal-plastic resin plastic.

4. The invention of claim 1, wherein said decelerator seat is molded from polypropylene thermal-plastic resin.

5. The invention of claim 1, wherein said decelerator pad is formed of molded rubber.

6. The invention of claim 1, wherein said platform members are injection-molded plastic with embedded, non-slip, top-textured, graphic decorated interior surfaces, and exterior surfaces molded with reinforced ribs and a waffle configuration and grooves to align, space, and secure said platform members to said platform beam.

7. The invention of claim 1, wherein said planar surfaces are removably mounted to said platform beam for replacement with other planar surfaces.

* * * * *

UNITED STATES PATENT AND TRADEMARK OFFICE

CERTIFICATE OF CORRECTION

PATENT NO. : 5,927,734

DATED : July 27, 1999

INVENTOR(S) : Edward N. Horton, II;
Michael E. Smith

It is certified that error appears in the above-indentified patent and that said Letters Patent is hereby corrected as shown below:

On title page, item [73], after Assignee:
please delete "Rod"
and insert --Rad--.

Item [57], under ABSTRACT, line 7:
please delete "improved".

Signed and Sealed this

Eighteenth Day of April, 2000

*Attest:*

Q. TODD DICKINSON

*Attesting Officer*

*Director of Patents and Trademarks*